US008550568B2

(12) United States Patent
Incoronato

(10) Patent No.: US 8,550,568 B2
(45) Date of Patent: Oct. 8, 2013

(54) COLLECTING DEVICE AND A METHOD FOR USING SAME

(75) Inventor: Arne Incoronato, Tananger (NO)

(73) Assignee: OTT Subsea Bag Technology AS, Tananger (NO)

( * ) Notice: Subject to any disclaimer, the term of this patent is extended or adjusted under 35 U.S.C. 154(b) by 382 days.

(21) Appl. No.: 12/808,514

(22) PCT Filed: Dec. 15, 2008

(86) PCT No.: PCT/NO2008/000447
§ 371 (c)(1),
(2), (4) Date: Aug. 5, 2010

(87) PCT Pub. No.: WO2009/078731
PCT Pub. Date: Jun. 25, 2009

(65) Prior Publication Data

US 2010/0303558 A1 Dec. 2, 2010

(30) Foreign Application Priority Data

Dec. 19, 2007 (NO) ..... 20076546

(51) Int. Cl.
*E21B 21/06* (2006.01)

(52) U.S. Cl.
USPC ..... 299/9; 299/7; 299/8; 166/357

(58) Field of Classification Search
USPC ..... 299/7, 8, 9; 209/422; 166/357; 405/129.85
See application file for complete search history.

(56) References Cited

U.S. PATENT DOCUMENTS

| | | | | |
|---|---|---|---|---|
| 3,817,383 | A | 6/1974 | Michel et al. | |
| 3,971,593 | A | 7/1976 | Porte et al. | |
| 4,133,761 | A | 1/1979 | Posgate | |
| 5,004,051 | A | 4/1991 | Rosendahl et al. | |
| 5,232,475 | A * | 8/1993 | Jepson | 166/357 |
| 6,062,313 | A | 5/2000 | Moore | |
| 6,796,379 | B1 | 9/2004 | Martin | |
| 7,086,472 | B1 | 8/2006 | Incoronato | |
| 2004/0031623 | A1 | 2/2004 | Fontana | |
| 2005/0252685 | A1 | 11/2005 | Hollier | |
| 2007/0012630 | A1 * | 1/2007 | Wright et al. | 210/704 |
| 2011/0017668 | A1 * | 1/2011 | Mock et al. | 210/650 |

FOREIGN PATENT DOCUMENTS

| | | |
|---|---|---|
| NO | 173521 | 3/1991 |
| NO | 322231 | 4/2002 |
| NO | 321889 | 5/2002 |
| NO | 320113 | 6/2005 |
| WO | WO 99/46474 | 9/1999 |

* cited by examiner

*Primary Examiner* — David Bagnell
*Assistant Examiner* — Carib Oquendo
(74) *Attorney, Agent, or Firm* — GableGotwals

(57) ABSTRACT

The present invention relates to a collecting device (1) for solids material which is moved by means of a fluid from a first location on a seabed, on an offshore installation or on land to a second location, the fluid carrying the solids material in through an inlet portion (7) of the collecting device (1), the collecting device (1) being provided with one or more permeable portions arranged to retain the solids material exceeding a predetermined size. The invention also relates to a method of using the collecting device (1), the method including the abandoning of a filled collecting device (1).

9 Claims, 3 Drawing Sheets

COLLECTING DEVICE AND A METHOD FOR USING SAME

The present invention relates to a collecting device and a method of using same. More particularly, it relates to a collecting device for solids material which is moved by means of a fluid from a first location on a seabed, on an offshore installation or on land to a second location, the fluid carrying the solids in through an inlet portion of the collecting device.

During digging or drilling in the ground on a seabed or on land, mass is cut loose, which needs to be removed from the digging or drilling area. When being handled, the loosened mass may represent a disadvantage as it may spread to the surrounding environment.

From the U.S. Pat. No. 320,113, the holder of which is is the inventor of the present invention, when drilling the top hole section of a petroleum well on the seabed, are known a method and collecting device for removing watery cuttings returned from the top section of a borehole. The cuttings are pumped into a collecting device which is then lifted to the sea surface and aboard a vessel. The collecting device is provided with draining features so that liquid is drained from the collecting device as it is hoisted aboard the vessel.

Even though the collecting device and method have turned out to work satisfactorily, they are encumbered with some drawbacks. One of these drawbacks is related to the fact that in particular when the collecting device is lifted from the seabed up to the vessel, the fines that are in the collecting device together with the cuttings may get drained out of the collecting device together with the liquid. The fines drained out could represent a pollution problem. Another drawback relates to the capacity of the collecting device. Because it should be possible for the collecting device to be hoisted aboard a vessel, its size is limited to typically 25 $m^3$. The collecting device must, therefore, relatively frequently be connected to and disconnected from the pumping device and the lifting device which carries the collecting device up to the surface. Such handling on the seabed is usually carried out by means of a so-called ROV (remote-operated vehicle) which is relatively expensive to operate. In addition it is expensive to carry the cuttings to shore for further processing and disposal.

When, for example, dredging a seabed, for example, there is sometimes no need for, or there may be a requirement for, the mass to be removed from the seabed. However, it is in the nature of the matter that the mass must be moved from a first area to a second area on the seabed. It is known that this moving of mass is carried out by pumping the mass away from the area from which the mass is removed. A substantial drawback of this type of dredging operation is that large areas downstream of the dredging operation become covered by the mass. This mass might destroy the benthic fauna. It is therefore required some places that the dredging mass, or mass removed in some other manner, must be pumped ashore for possible cleaning and disposal in approved disposal sites. This is a very expensive operation.

When disposing of non-degradable waste from the mining or processing industry, it is known to place it at open disposal sites on land or in the sea. In the cases in which such non-degradable waste includes fines particles it has turned out to be problematic to prevent spreading of the non-degradable waste to surrounding areas. The problem is particularly large while the mass is being moving.

The invention has for its object to remedy or reduce at least one of the drawbacks of the prior art.

The object is achieved through features which are specified in the description below and the claims that followed.

In a first aspect of the present invention a collecting device is provided for solids material which is moved by means of a fluid from a first location on a seabed, on an offshore installation or on land to a second location, the fluid carrying the solids material in through an inlet portion of the collecting device, and the collecting device being provided with one or more permeable portions arranged to retain the solids material exceeding a predetermined size.

By an offshore installation is meant herein a fixed or floating installation such as a rig, or a floating vehicle such as a ship or a barge.

In a preferred embodiment the collecting device is constituted by a container. The container is preferably closed, at least initially, in the sense that it provides a room which separates the solids material over a predetermined size from the surroundings outside the container.

In one embodiment the at least one permeable portion has an increasing degree of permeability in a direction from the inlet portion towards one or more portions at a distance from the inlet portion of the collecting device.

The increasing degree of permeability is provided in one embodiment by means of altering the size of openings in the wall portion of the collecting device. As an alternative or addition to said altered sizes, the increasing degree of permeability may be provided by increasing the size of the permeable wall portions.

In one embodiment the at least one permeable portion of the collecting device is provided with openings of a first size, there being placed at a distance from the inlet portion at least one outlet opening which has an opening of a second size, the first size being smaller than the second size. In one embodiment the outlet opening is formed by an open portion which is arranged to evacuate fluid at substantially the same rate as that at which fluid is pumped into the collecting device.

In one embodiment at least one of the at least one permeable portion is provided with openings which are 100 μm or smaller, preferably 50 μm or smaller.

The above-mentioned increasing degree of permeability and/or increased size of the outlet openings) has/have the effect that the fluid carrying the solids material in through the inlet portion of the collecting device will meet increasingly less resistance to evacuation from the collecting device the further away from the inlet portion the fluid is. Thereby the fluid carrying the solids particles into the collecting device may flow a longest possible distance inside the collecting device before being evacuated. Consequently, the major part of the fines too may be deposited in the collecting device before the fluid is evacuated from it.

Another important consequence of providing the above-mentioned increasing degree of permeability and/or outlet openings is that the collecting device may be placed in position in a packed-up state, for example folded or rolled up, at the site where it is to receive the solids material. Such a packed-up state is conditional on the collecting device being manufactured from, for example, a cloth-like material or being of such construction that it can be unfolded from a packed-up state into a fully unfolded state.

The fluid which is carried into the above-mentioned collecting device manufactured from, for example, a cloth-like material may initially evacuate out through the permeable portion or portions located nearest to the inlet portion. Some of the solids particles retained by the permeable portion will gradually clog the openings in it. Consequently, the fluid will move further away from the most adjacent, but now clogged, permeable portion or portions. The result will be that the fluid will cause an inflation or expansion of the collecting device as the fluid and solids particles are carried in through the inlet portion.

In one embodiment the collecting device is provided with at least one internal flow-restricting device. The at least one flow-restricting device contributes to, among other things, reducing the flow rate of the fluid inside the collecting device and thereby to an increased degree of sedimentation of the solids particles of the fluid. The at least one flow restriction could also contribute to increased form stability and to increasing the mechanical strength of the collecting device.

In one embodiment, at least portions of the collecting device are produced from a biologically degradable material. The effect of this is that, after some time, the mass which has been carried into the collecting device will be uncovered and a natural fauna on a seabed or on land may develop.

In a second aspect of the present invention is provided a method of collecting a solids material which is moved from a first location on a seabed or on land to a second location, the method including the steps of:

placing a collecting device, which is provided with one or more permeable portions arranged to retain solids material over a predetermined size, at said second location;

moving the solids material by means of a fluid which is carried in through an inlet portion of the collecting device; and after the moving of the solids material has been completed or the collecting device has been filled with a predetermined is amount of solids, permanently abandoning the filled collecting device. The abandoning may be permanent or temporary.

In what follows is described an example of a preferred embodiment which is visualized in the accompanying drawings, in which.

Figure 1:
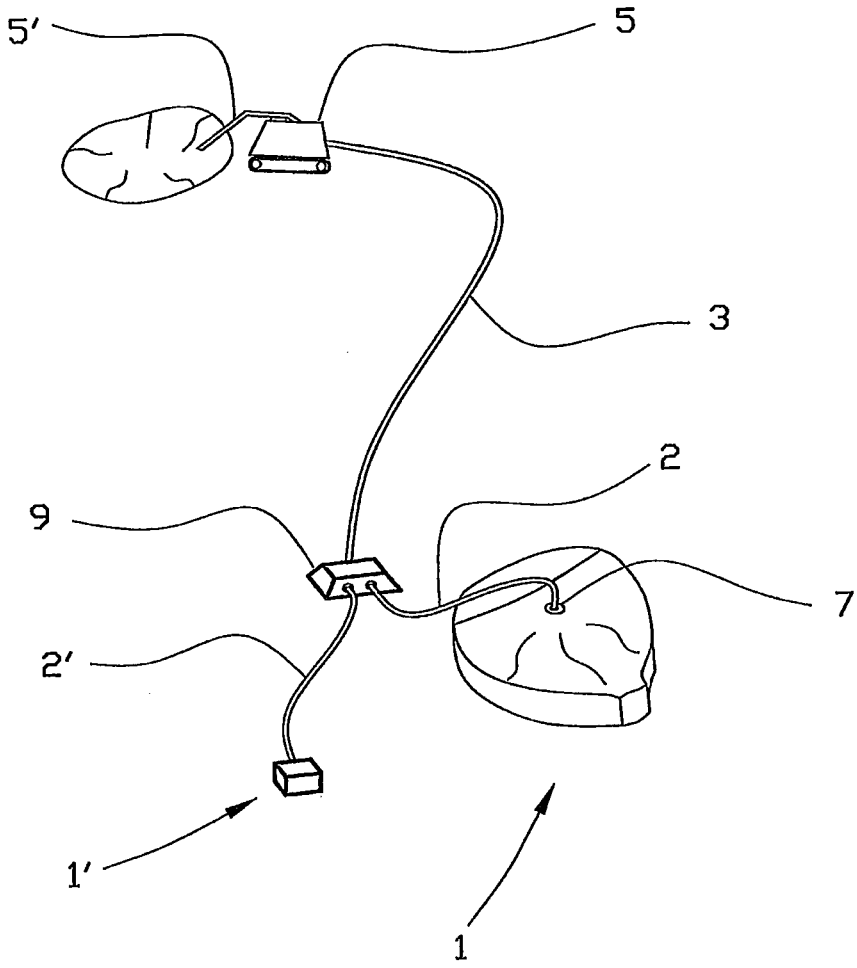
FIG. 1 shows a dredging operation taking place on a seabed, the mud mass being pumped via a conduit from a dredger into a collecting device which is partially filled with mass.

In the figures the reference numeral 1 indicates a collecting device in accordance with the present invention, a conduit 2, 3 extending between an inlet portion 7, placed at an upper portion of the collecting device 1, and a dredger 5 known per se.

The dredger 5 is provided with a suction conduit 5' which sucks mud mass and water, the mud mass and water being pumped via the conduit 3, 2 into the collecting device 1. A person skilled in the art will understand that one or more pump devices (not shown) can be connected to the conduit 3.

The collecting device 1 shown is manufactured from a cloth-like material, the collecting device 1 being formed by the same type of material with the same permeability properties.

In FIG. 1 two collecting devices 1, 1' are placed side by side. One collecting device 1 is partly filled with mud mass, whereas the other collecting device 1' is in a packed-up position. Both collecting devices 1, 1' are connected to a distribution frame 9, but only the conduit 2 from the collecting device 1 is in fluid communication with the dredger 5. Thus, the conduit 2' extending between the packed-up collecting device 1' and distribution frame 9 is not in fluid communication with the conduit 3.

When the fluid from the dredger 5 is supplied to the collecting device 1, the water driving the mud mass may be evacuated out through the permeable wall portions of the collecting device 1. To begin with, the wall portions will have the same permeability as, in the embodiment shown, the collecting device is made of a homogenous material. But, as the permeability is reduced in consequence of the open pores of the wall portions being clogged up by particulate material, the differential pressure between the inside and outside of the collecting device 1 will increase, whereby the pressure inside the collecting device will increase.

This increased pressure will result in the collecting device 1 being expanded until new permeable cloth material is provided or exposed for evacuation of the water. The internal pressure in the collecting device 1 will then be reduced and a new expansion will take place only when said new cloth material too is clogged by the particulate material. In this way there will be a stepped expansion of the collecting device 1 until it has reached its full size as shown in FIG. 2.

Figure 2:
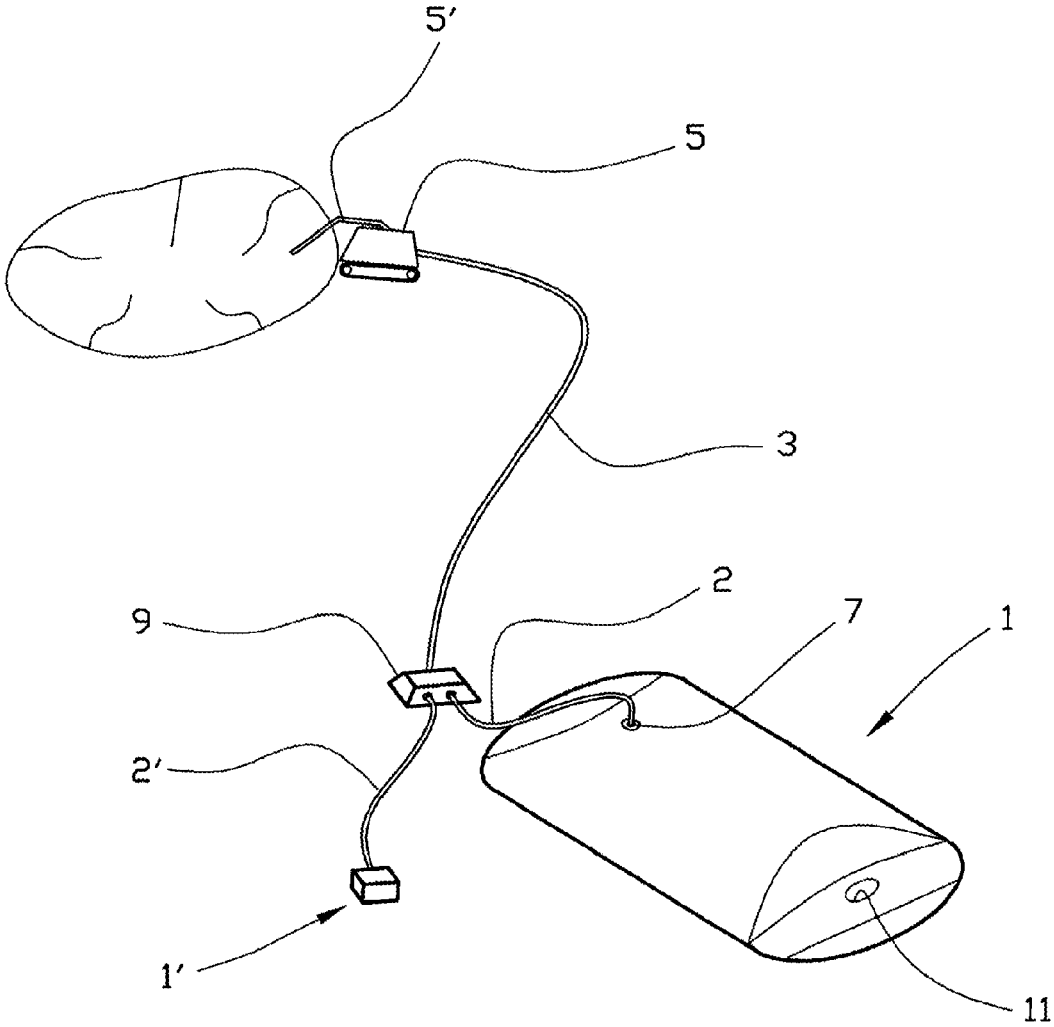
FIG. 2 shows the same as FIG. 1, but the collecting device has been expanded to its full size.

In FIG. 2 the collecting device 1 is still supplied with fluid from the dredger 5. The major part of the bottom portion of the collecting device 1 will now be covered with particulate material, but with the most material below the inlet portion 7 where coarse material will settle first.

At an end portion distal to, or at a distance from, the inlet portion 7, the collecting device 1 is provided with an outlet opening 11 which is shown in an embodiment in which a portion of the wall of the collecting device 1 is provided with an aperture. In an alternative embodiment (not shown) the outlet opening may be formed by one or more portions with greater permeability than all or parts of the rest of the collecting device 1.

As the upper portion of the collecting device 1 is essentially supported by the fluid supplied, there is formed, between the inlet portion 7 and outlet portion 11, a flow channel between deposited solids particles and said upper portion.

A collecting device 1 according to the invention may, according to need, material strength and possible statutory restrictions, such as a height restriction for so-called overtrawlability, be produced in a great many different sizes. By operations on the seabed, trials have shown that a collecting device 1 with a length of 30-50 m and a width or diameter of 10-20 m has turned out to be well suited.

By a size as suggested above, a person skilled in the art will understand that said flow channel may be very big, whereby fluid supplied to the inlet portion 7 may have a dwell time in the collecting device 1 of several hours. In the course of the dwell time substantially all of the particulate material of the fluid will sink to the bottom within the collecting device 1, whereas water which is thereby practically free of particles will flow out through the outlet 11 and/or through open portions of the walls of the collecting device 1.

As a person skilled in the art will understand, and as mentioned above, the coarsest material settles under or close to the inlet portion 7 of the collecting device 1, whereas the material which is carried in said flow channel inside the collecting device 1 will become finer and finer towards the outlet opening 11. The collecting device 1 is therefore subjected to the greatest load at an inlet section located at the inlet portion 7, and the least load at portions located at a distance from the inlet portion 7, such as the outlet opening 11. In one embodiment (not shown), the collecting device 1 is therefore manufactured from two or more materials of different strengths, and then with the most strength at the inlet portion and the least strength at one or more end portions located at a distance from the inlet portion. Such a differentiation may, among other things, reduce the material costs of a collecting device 1 according to the invention.

However, it will be understood that the composition of the collecting device 1 with respect to strength could be affected also by other criteria, such as the need to be able to move the collecting device after the filling with particulate material has been started or completed.

When the collecting device 1 has been sufficiently filled, the conduit 2 is removed from the inlet portion 7. The top portion of the collecting device 1, which has been expanded by the fluid that was supplied through the inlet portion 7, will then collapse and sink down to the top of the mass present in the collecting device 1. New collecting devices 1 may be laid on top of such a packed-up collecting device 1.

To start filling the collecting device 1' which is in a packed-up position beside the abandoned collecting device 1, the conduit 2' is connected to the conduit 3 in the distribution frame 9, possibly by means of a valve (not shown). This may be done, for example, by means of an ROV known per se.

Figure 3:
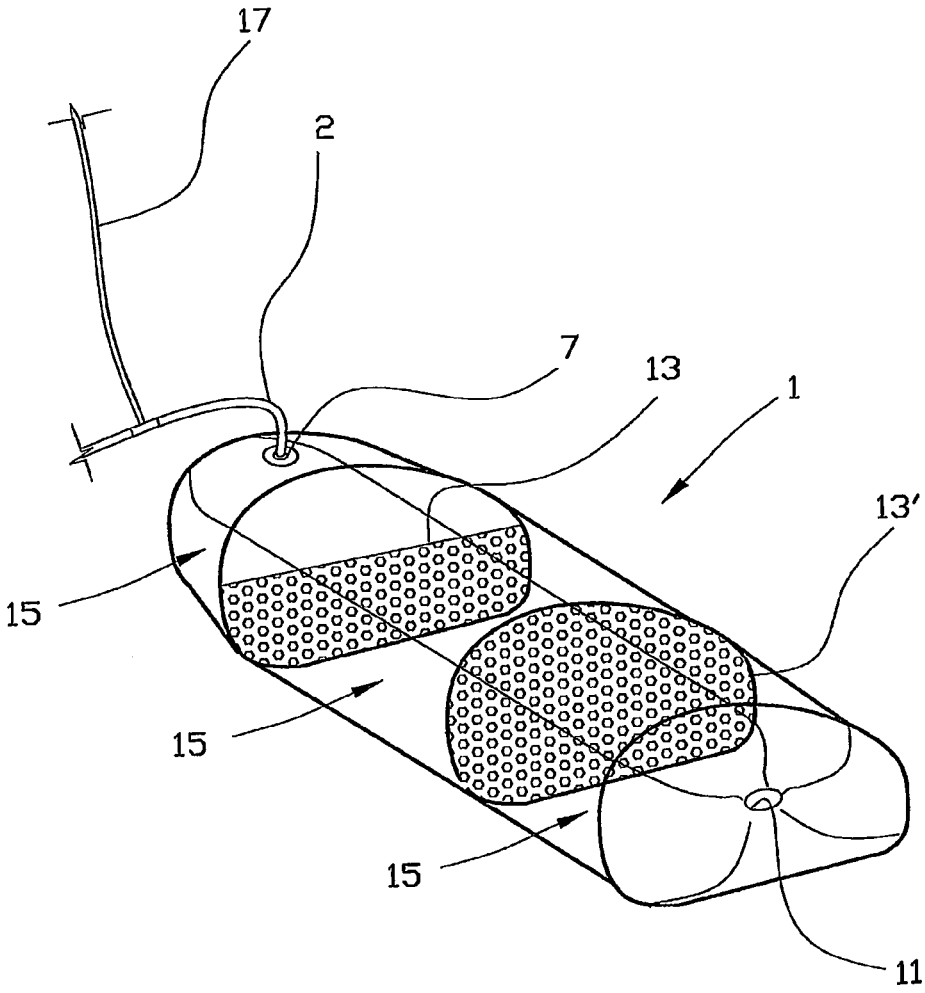
FIG. 3 shows, on a larger scale, a collecting device which is provided with two different types of flow restrictors. For reasons of illustration the collective device is shown transparent.

In FIG. 3 is shown an embodiment of a collecting device 1 in accordance with the invention, in which two transverse walls 13, 13' are placed inside the collecting device 1 and transversally to its longitudinal direction between the inlet portion 7 and the outlet portion 11. The transverse wall 13 located nearest to the inlet portion 7 projects from the bottom portion of the collecting device 1 and approximately halfway up towards the top portion. The transverse wall 13' nearest to the outlet opening 11 covers the entire internal cross section of the collecting device 1.

It will be understood that any number of transverse walls 13, 13' may be placed inside the collecting device, even though two are shown in FIG. 3. Further, it will be understood that the transverse walls 13, 13' may be placed at any desired angle to said longitudinal direction.

The transverse walls 13, 13' have two purposes. Firstly, the transverse walls 13, 13' will function as bracing elements reinforcing the wall portions of the collecting device 1. Secondly, depending on their permeability, the transverse walls 13, 13' may function as a flow restriction, thereby defining chambers 15 in the collecting device 1. The chambers 15 may facilitate the inflation of the collecting device 1 and, at the same time, bring about a reduced flow rate of the fluid. A reduced flow rate will result in yet longer dwell time for the fluid in the collecting device 1 and thereby settling of fines nearer to the inlet opening 7 as compared with a collecting device 1 without transverse walls 13, 13'.

It will be understood that the transverse walls 13, 13' may cover all or only portions of a sectional area of the collecting device 1.

In FIG. 3 is also shown a further conduit 17 which is connected to the supply conduit 2 upstream of the inlet opening 7. The purpose of the conduit 17 is to enable the addition of a binder or precipitating agent which helps to make the particulate substance occurring in a dispersed state in the liquid phase flocculate so that the particles will gather into larger and heavier particles and thereby bring about a faster and more efficient separation and sedimentation of the solids material. The binder is preferably an environmentally friendly chemical of a kind known per se. Preferably, the binder is an organic binder.

It will be understood that the collecting device 1 could be connected to systems (not shown) already existing, arranged to separate sand from well production, a so-called "subsea sand separator".

In some cases there may be a need for moving the collecting device after it has been filled, completely or partially, with particulate material. In one embodiment (not shown), the collecting device 1 is therefore provided with devices enabling movement of the collecting device 1 along the seabed or in the water masses. The devices may be lifting lugs for the connection of lifting devices such as a crane on a surface vessel and/or inflatable buoyancy elements.

The invention claimed is:

1. A collecting device for solids material which is moved by means of a fluid from a first location on a seabed, on an offshore installation or on land to a second location, said collecting device comprising:

the collecting device being made of a flexible material and having an inlet, an outlet, and a wall portion arranged therebetween;

wherein the collecting device further comprises at least one permeable portion arranged to retain solids material exceeding a predetermined size and having an increasing degree of permeability in a direction from said inlet towards the outlet; and further wherein the collecting device is packaged in a first, compact, rolled or folded state and is arranged to inflate in response to fluid pressure from the fluid carrying the solids material into a second expanded state.

2. The collecting device in accordance with claim 1, wherein said at least one permeable portion of the collecting device is selected from the group consisting of the wall portion, one or more transversely arranged permeable panels, and a combination of the wall portion and the one or more transversely arranged permeable panels.

3. The collecting device in accordance with claim 1, wherein the increasing degree of permeability is provided by means of larger openings in a wall portion of said collecting device.

4. The collecting device in accordance with claim 1, comprising a plurality of permeable panels, the first being provided with openings of a first size, and a subsequent panel being provided with openings of a larger size.

5. The collecting device in accordance with claim 1, wherein said outlet opening is formed by an open portion which is arranged to evacuate fluid at substantially a same rate as that at which fluid is carried into said collecting device.

6. The collecting device in accordance with claim 1, wherein said collecting device is provided by means of at least two materials with different mechanical properties.

7. The collecting device in accordance with claim 6, wherein said collecting device has greater mechanical strength at an inlet section than at one or more portions located at a distance from the inlet section.

8. The collecting device in accordance with claim 1, wherein at least portions of said collecting device is manufactured from a biologically degradable material arranged to degrade after a certain time when exposed to seawater.

9. The collecting device in accordance with claim 1, wherein the fluid is carried into said collecting device by means of a pumping device.

* * * * *